United States Patent [19]

Silvia

[11] Patent Number: 4,685,500

[45] Date of Patent: Aug. 11, 1987

[54] CLEAT COVER

[76] Inventor: Dana Silvia, 43 Border St., Cohasset, Mass. 02025

[21] Appl. No.: 904,012

[22] Filed: Sep. 4, 1986

[51] Int. Cl.[4] ..... B63B 21/04

[52] U.S. Cl. ..... 150/52 R; 114/218; 206/525

[58] Field of Search ..... 114/218, 217; 150/52 R; 206/525

[56] References Cited

U.S. PATENT DOCUMENTS 3,198,160 8/1965 Anderson ..... 114/218
3,213,960 10/1965 Wagner ..... 150/52 R
3,587,700 6/1971 Mauer ..... 150/52 R
4,354,445 10/1982 Kafka ..... 114/218
4,417,613 11/1983 Ryan et al. ..... 150/52 R

FOREIGN PATENT DOCUMENTS 24722 of 1907 United Kingdom ..... 150/52 R

*Primary Examiner*—William Price
*Attorney, Agent, or Firm*—William Nitkin

[57] ABSTRACT

A cleat cover having a first portion with an aperture defined therein in the general shape of a portion of said cleat and a second cover portion having an aperture defined therein in the general shape of the other portion of the cleat, such cover portions adapted to be placed and held together around the cleat with the cleat in the apertures to cover the cleat.

9 Claims, 4 Drawing Figures

CLEAT COVER

BACKGROUND OF THE INVENTION

1. Field of the Invention

The device of this invention relates to an apparatus for the covering of a cleat and more particularly relates to an easily installable and quickly removable cleat cover.

2. Description of the Prior Art

Cleats are well known in the prior art for the securing of lines thereto. They are utilized on boats and in other places where lines must be attached such as on trucks, buildings, and the like. Cleats are also frequently used for the attachment of lines at the base of flagpoles. When cleats are installed on sailboats, one can easily catch one's foot under the cleat and trip because the cleat arms protrude upwards above the deck or other positioning on the boat where they are located. Further fishing lines can often become entangled in the protruding arms of the cleat.

SUMMARY OF THE INVENTION

It is an object of this invention to provide a cover for a cleat to prevent tripping thereover, or the catching of clothing, lines or other items thereon.

It is a further object of this invention that such cover be easily and quickly installable and removable and that it not look unsightly. Also in some situations, the cleat cover of this invention can be locked in position to function as protection against removal of a line secured to the cleat of a flagpole as will be described below.

It is yet still a further object of this invention to provide a device to protect a cleat. For example, one might wish to cover a polished brass cleat to protect it from the elements. Thus the device of this invention not only can be used to protect items from being caught on a cleat but also can be used to protect the cleat itself from damage.

DESCRIPTION OF THE PREFERRED EMBODIMENT(S)

Figure 1:
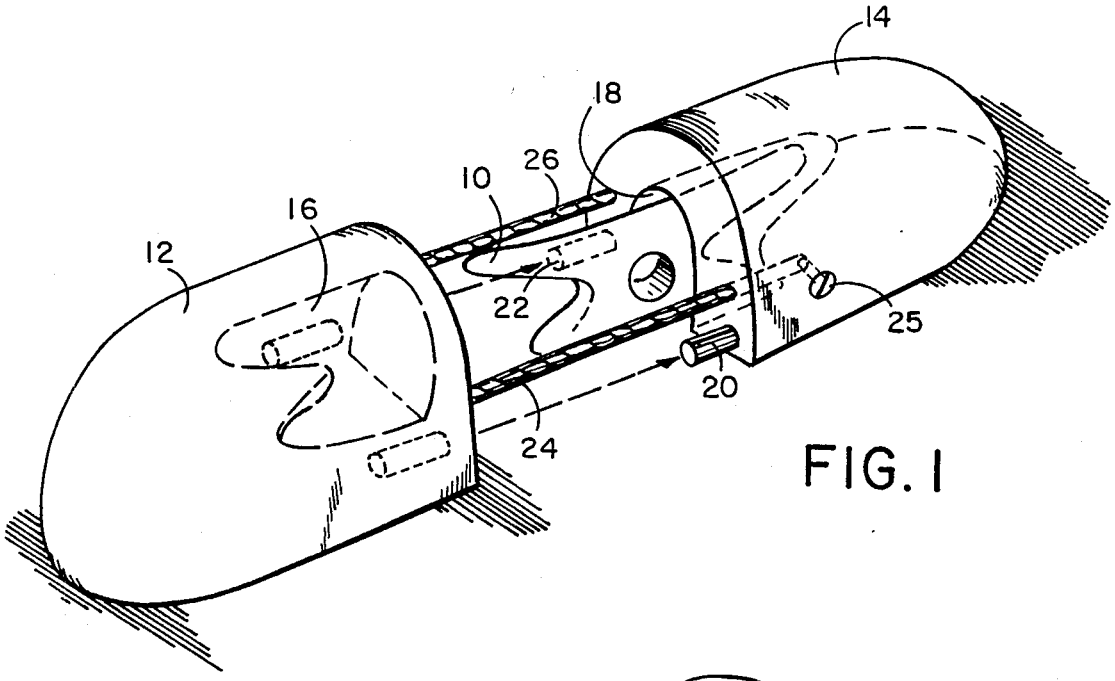
FIG. 1 is a perspective view of the device of this invention with one part thereof pulled away exposing the cleat.

FIG. 1 illustrates a perspective view of the device of this invention which is comprised basically of two portions. In this view the two portions are seen pulled apart, exposing a portion of cleat 10. First cleat cover portion 12 is rounded on its end and semi-cylindrical in shape being flat on the bottom with a carved-out portion 16 adapted to be in the shape of, and receive, one half of cleat 10 so that cover part 12 can be slid on over one-half of cleat 10. Coverpart 14 is also of a similar shape as cover portion 12 which has a similar aperture 18 defined therein to receive the other half of cleat therein and can be positioned on the other side of the cleat from cover portion 12 to cover the cleat completely. In the embodiment shown, cover portions 12 and 14 are held in position on the cleat by elastic cord 24 which runs between the two which in the position as shown is under tension with cover portion 14 being pulled toward cover portion 12. Cord 24 and cord 26 on the other side of the cleat, in the cover's non-pulled apart position would hold cover portion 14 to cover portion 12 under some tension, thereby retaining the entire cover structure on the cleat. The cover cannot be removed upwards from the cleat because when the cleat arms are within apertures 18, they lock the cleat laterally. To prevent any lateral movement of cover portion 14 from cover portion 12 when positioned on cleats of different sizes, a male protrusion 22 on one portion of the coyer 14 can be inserted into a female aperture 16 on cover portion 12, thereby preventing lateral movement. Such keying elements can also be provided on the other side of the cleat as illustrated. Elastic cords 24 can be retained within apertures formed within each side of the cover with fastening means at the ends of the apertures retaining the cords in position such as a screw member 25 extending from outside the shell of the cover into the elastic cord to retain it in position. In this fashion when in use, one merely pulls back on one portion of cover portion 14 to the point where it is beyond the tip of the arm of the cleat and then lifts it upwards so that when the cord retracts it against the other cover portion, its aperture no longer engaging the arm of cleat 10 and then one merely removes by sliding rearward the opposite cover 12 so that it is also removed from the cleat. By reversing the above-mentioned steps, one can easily install the device by inserting the first portion of cover portion 12 onto one end of cleat 10 and then pulling the other portion, tensioning cord 24 until aperture 16 is beyond the end of the arm of cleat 10 and then allowing the cord to naturally retract to a point which still may be under some tension to hold the opposite cover portion 14 against cover portion 12 with the mating key 20 locking into the aperture 22 and the like to prevent any lateral movement. When cover portion 14 is pulled by cord 24 back tightly against cover portion 12, the two cover portions 12 and 14 act to protect cleat 10 from anyone or anything getting caught under the cleat arms. The rounded sides and ends of the cover portions make the cover of this device attractive and do not present a danger of snagging the way the protruding arms of an uncovered cleat do.

Figure 2:
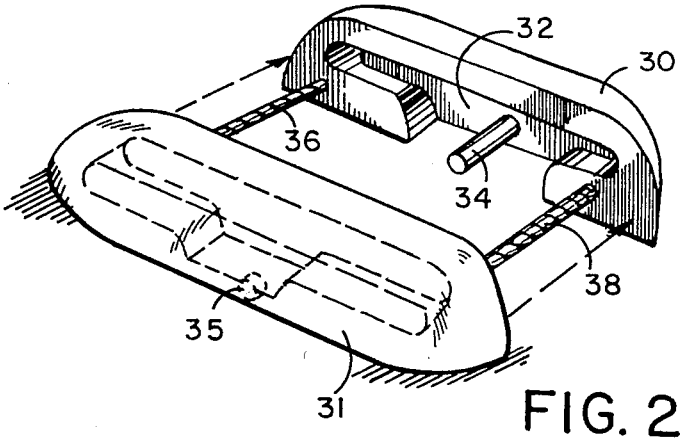
FIG. 2 is an alternate embodiment of this invention wherein the device splits longitudinally rather than laterally.

An alternate embodiment is seen in FIG. 2 wherein tbe cleat cover is split longitudinally with sides 30 and 31 each having defined therein an aperture such as aperture 32 in the general shape of the cleat to be covered. These members can be retracted together by elastic cords 36 and 38 to hold the sides tightly together against and around the cleat. A key member 34 can also extend into and opposite aperture 35 in side cover 31 to pass through the commonly found aperture in the center of cleats although similar keys on the sides such as 20 and 22 could also be used if located near cords 36 and 38, respectively.

Figure 3:
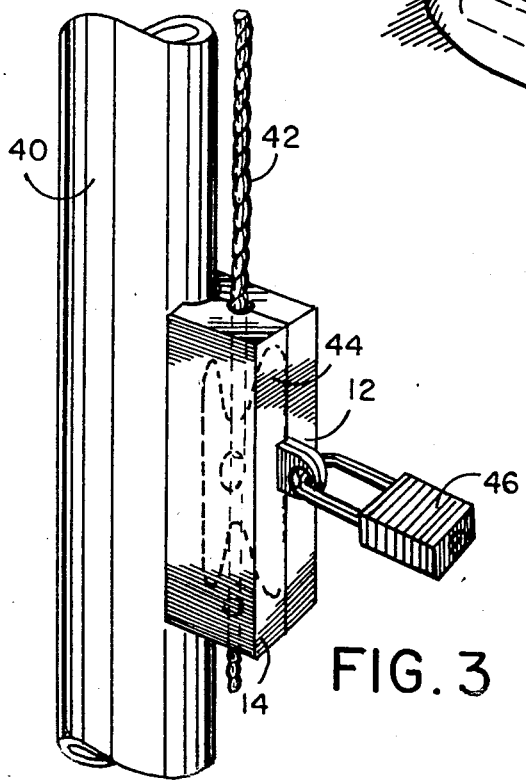
FIG. 3 illustrates the device of this invention with locking means and line entry means provided for use on, for example, flagpoles and the like to lock the lines in place.

In a further alternate embodiment seen in FIG. 3 one end of the cover portion can be removed to allow a line to extend from around the cleat. In this version the cleat is seen mounted on flagpole 40 with line 42 around cleat 44 wherein the cover is positioned in place and locked by lock 46 which holds the two sides together. In this way no one can remove the line from the flagpole as it is securely locked by the cover device of this invention. It should be noted that the cover device of this invention can also be used to lock lines in place if apertures are provided in them which allow the device to be used as a security device to prevent theft of sailboats and the like where individuals are unable to remove particular lines without cutting them away which would cause inconvenience to a potential thief by making it more difficult to steal such a sailboat.

Figure 4:
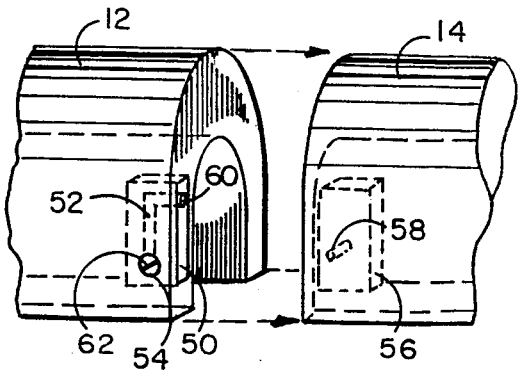
FIG. 4 illustrates an alternate locking means.

FIG. 4 illustrates an alternate emhodiment of a locking means suitable for use on laterally split cover portions 12 and 14. Seen in this view are chambers 50 and 56 which are located near a side of each cover portion and are open where they join, being positioned opposite one another. In chamber 50 arm 52 with catch member 60 at its end is rotatably mounted on shaft 54 and can be moved by a key or screwdriver in slot 62 so as to rotate downward and out of chamber 50 and into chamber 56 when cover portions 12 and 14 are in contact with one another. Catch member 60 then passes behind catch shaft 58 extending across aperture 56 so as to catch therebehind and lock cover portions 12 and 14 together. To unlock the cover portions from one another, one reverses the movement of shaft 54 and arm 52 rises releasing catch shaft 58 and returns into chamber 50 where it stays out of the way. More than one such locking mechanism can be used to hold the cover portions together.

Although the present invention has been described with reference to particular embodiments, it will be apparent to those skilled in the art that variations and modifications can be substituted therefor without departing from the principles and spirit of the invention.

I claim;

1. A device for covering a cleat comprising:

a first cover portion having an aperture defined therein, said aperture being of a size and shape somewhat larger than the size and shape of half said cleat;

a second cover portion having an aperture defined therein, said aperture being of a size and shape somewhat larger than the size and shape of the other half of said cleat;

said first and second cover portions adapted to be placed together around said cleat to cover said cleat;

elastic means positioned between said first and second cover portions adapted to hold said cover portions in place around said cleat and when said cover portions are removed, said elastic means adapted to stretch to allow the release of first one cover portion and then the other cover portion from said cleat; and further including key members on said first cover portion, said device having mating apertures defined on said second cover portion adapted to allow said cover portions to be locked in position to one another.

2. The device of claim 1 further including:

entry means to allow passage of a rope through at least one of said cover portions to allow a rope to be tied to said cleat; and locking means to hold said cover portions together.

3. A cleat-covering device comprising:

a first cover portion having an aperture defined therein, said first cover portion adapted to receive longitudinally one arm and up to half of a cleat, said first cover portion being rounded on its top and curved off at its end and flat on its bottom;

a second cover portion having an aperture defined therein, said said second cover portion adapted to receive longitudinally therein the remaining portion of the other side of said cleat and cleat arm, said second cover portion also being rounded on its top, curved off at its end with a flat bottom; and elastic means fixed between said first and said second cover portions, said elastic means adapted to hold said first and second cover portions together when in position on said cleat, said elastic means having sufficient elasticity to allow at least one of said cover portions to be pulled back beyond the end of a cleat arm so as to completely release one arm of said cleat from said aperture defined in said cover portion thereby allowing the other cover portion to be removed from said cleat.

4. The device of claim 3 wherein one of said cover portions contains a male key and the other cover portion has a mating female aperture defined therein for receipt of said key to allow locking of said key into said aperture to prevent lateral movement of said first and second cover portions.

5. A cleat-covering device comprising:

a first cover portion having an aperture defined therein, said first cover portion adapted to receive laterally one arm and up to half of a cleat, said first cover portion being rounded on its top and curved off at its end and flat on its bottom;

a second cover portion having an aperture defined therein, said said second cover portion adapted to receive laterally therein the remaining portion of the other side of said cleat and cleat arm, said second cover portion also being rounded on its top, curved off at its end with a flat bottom; and elastic means fixed between said first and said second cover portions, said elastic means adapted to hold said first and second cover portions together when in position on said cleat, said elastic means having sufficient elasticity to allow at least one of said cover portions to be pulled back beyond the end of a cleat arm so as to completely release one arm of said cleat from said aperture defined in said cover portion thereby allowing the other cover portion to be removed from said cleat.

6. The device of claim 5 wherein said cover portions have elastic cord means adapted to hold said cover portions together, said elastic means being stretchable enough to allow said cover portions to be pulled back away from said cleat to allow said cover portions to be removed from said cleat.

7. The device of claim 6 wherein one of said cover portions has a key adapted to be inserted into an aperture defined in the other cover portion, said key adapted to pass through an aperture defined in the central portion of said cleat.

8. The device of claim 3 wherein at least one of said cover portions has a section thereof removed to allow for a line to be inserted and tied to said cleat when said cover portion is installed thereon and further including locking means adapted to hold said first and second cover portions together around said cleat.

9. The device of claim 5 wherein at least one of said cover portions has a section thereof removed to allow for a line to be inserted and tied to said cleat when said cover portion is installed thereon and further including locking means adapted to hold said first and second cover portions together around said cleat.

* * * * *